US010902727B1

(12) United States Patent
Uyeki et al.

(10) Patent No.: US 10,902,727 B1
(45) Date of Patent: Jan. 26, 2021

(54) PARKED VEHICLE WARNING INFRASTRUCTURE

(71) Applicant: Honda Motor Co., Ltd., Tokyo (JP)

(72) Inventors: Robert Uyeki, Torrance, CA (US); Matthew Staal, Torrance, CA (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/718,666

(22) Filed: Dec. 18, 2019

(51) Int. Cl.
*G08B 5/38* (2006.01)
*G08G 1/16* (2006.01)
*G08G 1/095* (2006.01)

(52) U.S. Cl.
CPC ..... *G08G 1/166* (2013.01); *G08B 5/38* (2013.01); *G08G 1/095* (2013.01); *G08G 1/164* (2013.01)

(58) Field of Classification Search
CPC ..... G08G 1/00; H04W 4/00
See application file for complete search history.

(56) References Cited

U.S. PATENT DOCUMENTS

| | | | | |
|---|---|---|---|---|
| 5,969,603 | A * | 10/1999 | Wang | B60Q 1/52 307/10.1 |
| 10,134,280 | B1 | 11/2018 | You | |
| 10,304,341 | B1 | 5/2019 | Crasso et al. | |
| 2014/0001961 | A1* | 1/2014 | Anderson | H04B 47/19 315/153 |
| 2016/0144915 | A1 | 5/2016 | Bejestan et al. | |
| 2017/0002527 | A1* | 1/2017 | Bahiri | E01F 9/571 |
| 2018/0090010 | A1 | 3/2018 | Ikehara et al. | |
| 2019/0111921 | A1 | 4/2019 | Hehn et al. | |
| 2019/0251844 | A1* | 8/2019 | Crasso | H04W 4/46 |
| 2020/0063938 | A1* | 2/2020 | Kurashige | G02B 5/0252 |

FOREIGN PATENT DOCUMENTS

| | | | |
|---|---|---|---|
| CN | 107103787 | A | 8/2017 |
| DE | 102017214258 | A1 | 2/2019 |
| WO | 2017083936 | A1 | 5/2017 |

OTHER PUBLICATIONS

Espacenet Machine Translation of DE Patent 102017214258 A1, Issued Feb. 21, 2019.
Espacenet Machine Translation of CN Patent 107103787 A, Issued Aug. 29, 2017.

* cited by examiner

*Primary Examiner* — Shirley Lu
(74) *Attorney, Agent, or Firm* — Plumsea Law Group, LLC

(57) ABSTRACT

A system and method for providing a parked vehicle warning infrastructure is described. In one embodiment, a method for providing a warning about parked vehicles includes receiving information associated with at least one of a parked vehicle or a personal transport device. The method also includes determining a location of one or more warning lights disposed in or near a roadway associated with the parked vehicle or the personal transport device. The method further includes sending an instruction to the one or more warning lights to illuminate. The illuminated one or more warning lights provide a warning to a user of the at least one of the parked vehicle or the personal transport device about a risk of a collision between the parked vehicle and the personal transport device.

20 Claims, 10 Drawing Sheets

PARKED VEHICLE WARNING INFRASTRUCTURE

BACKGROUND

The embodiments relate generally to vehicles, and in particular to a method and system for providing a parked vehicle warning infrastructure.

With rising prices of gasoline and automobiles, many people may turn to other more cost efficient modes of transportation such as, for example, mopeds, bicycles, scooters and, more recently, electric personal transport devices such as stand-up electric scooters or kick scooters. These personal transport devices may be particularly popular for shorter trips in a city environment due to their compact size, ease of use, mobility, and the fact that they may be folded as needed for ease of portability. They may also be useful for covering the first mile or last mile of a trip which is the link between a user's origin or destination and another transportation means, hub or mass transit network. Depending on the local laws and regulations, personal transport devices such as electric scooters may be required to remain in the flow of pedestrian or vehicular traffic. In a pedestrian traffic flow, the electric scooter may be required to use a cross-walk much as a pedestrian should. In a vehicular traffic flow, the electric scooter may be required to be operated much like a bicycle which should adhere to vehicle moving laws and norms.

As jurisdictions continue to refine the laws and regulations regarding use of these small personal transport devices there is an increasing risk to users from interactions with existing vehicles and infrastructure that was developed without consideration for personal transport devices. Accordingly, there is a need in the art for an improved infrastructure that can provide warnings about parked vehicles to drivers and users of personal transport devices.

SUMMARY

In one aspect, the disclosure provides a method for providing a warning about parked vehicles. The method includes receiving information associated with at least one of a parked vehicle or a personal transport device. The method also includes determining a location of one or more warning lights disposed in or near a roadway associated with the parked vehicle or the personal transport device. The method further includes sending an instruction to the one or more warning lights to illuminate. The illuminated one or more warning lights provide a warning to a user of the at least one of the parked vehicle or the personal transport device about a risk of a collision between the parked vehicle and the personal transport device.

In another aspect, a method of providing a warning of a potential accident or collision from a parked vehicle warning infrastructure is provided. The method includes receiving information, at a control system of the parked vehicle warning infrastructure, from at least one of a parked vehicle or a personal transport device. The method also includes using the received information to determine a location of a selected one or more warning lights disposed near a roadway. The method further includes illuminating the selected one or more warning lights near the roadway to provide a warning to a user of the at least one of the parked vehicle or the personal transport device about a risk of a collision between the parked vehicle and the personal transport device.

In another aspect, a system for a parked vehicle warning infrastructure is provided. The parked vehicle warning infrastructure including one or more warning lights located near a roadway and a control system for the parked vehicle warning infrastructure. The control system includes a communication interface configured to communicate with the one or more warning lights and at least one of a personal transport device or a vehicle traveling on or near the roadway. The control system also includes a processor configured to receive information associated with the at least one of the personal transport device or the vehicle, determine a location of a selected one or more of the warning lights near the roadway, and send an instruction to the selected one or more of the warning lights to illuminate.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Methods and systems for providing a parked vehicle warning infrastructure are described herein. The techniques of the present embodiments may be used to warn users of personal transport devices about parked vehicles that may pose a risk of collision to the users, as well as also providing warnings to drivers of vehicles to be alert for small personal transport devices that may be approaching the vehicle.

The example embodiments are described herein with reference to a personal transport device in the form of an electric scooter. As used herein, an electric scooter is a term used mainly to describe a stand-up kick scooter that is electrically powered. For example, this is a type of personal transport device that is gaining ridership in many locations. The principles of the example embodiments described herein may be applied to electric scooters or other types of personal transport devices that are motorized or electrified, such as bicycles, unicycles, mopeds, skateboards, wheelchairs, personal transporters, or the like.

Figure 1:
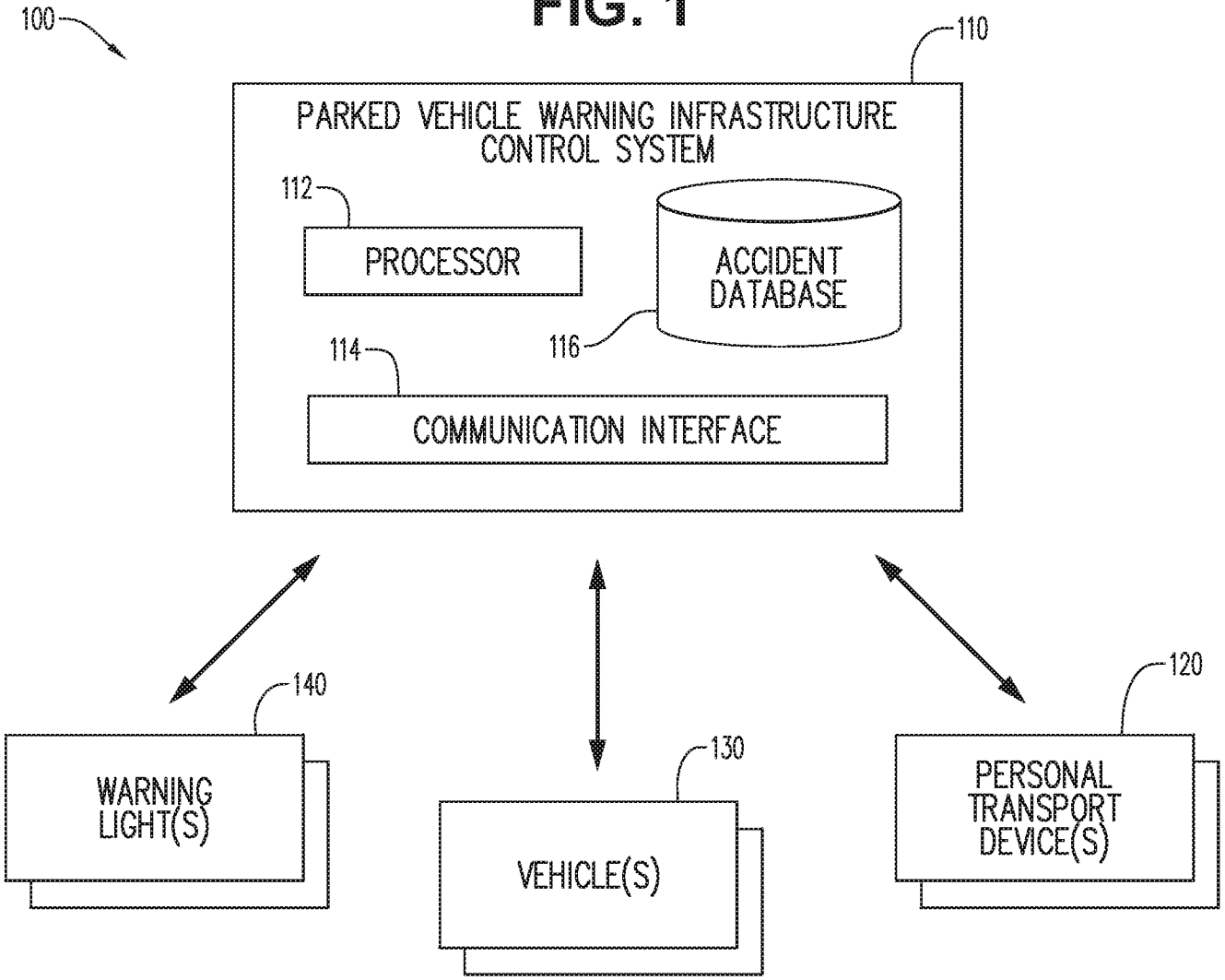
FIG. 1 is a block diagram of an example embodiment of a parked vehicle warning infrastructure.

Referring now to FIG. 1, a block diagram of a parked vehicle warning infrastructure 100 (also referred to herein as "warning infrastructure 100") for providing warnings to drivers and users of personal transport devices is shown. In an example embodiment, warning infrastructure 100 may be provided at various locations where there is a high density of small personal transport device and vehicular traffic, such as cities and other urban type environments. In this embodiment, warning infrastructure 100 includes a parked vehicle warning infrastructure control system 110 (also referred to herein as "control system 110") that is in communication with one or more personal transport devices 120, one or more vehicles 130, and one or more warning lights 140.

In an example embodiment, parked vehicle warning infrastructure control system 110 may include components embodied in hardware, software, or a combination thereof that are configured to implement the techniques described herein for providing a warning about parked vehicles to users of personal transport devices 120 and/or to drivers of vehicles 130. In this embodiment, control system 110 includes at least a processor 112 that is in communication with a communication interface 114 and an accident database 116. In some embodiments, processor 112 may be a dedicated central processing unit (CPU) configured to implement the techniques described herein. In other embodiments, processor 112 may be any computer or computing system, including, but not limited to configurations having multiple processors, one or more servers, and/or a distributed computing system that is located remotely from warning infrastructure 100.

In an example embodiment, communication interface 114 is configured to enable various wireless network communications, such as via code division multiple access (CDMA) and/or global system for mobile communications (GSM) networks, as well as one or more of Bluetooth, WiFi, and/or other wireless communication technologies, including short-range wireless, ultra-wideband, or near-field communication technologies. In this embodiment, communication interface 114 is configured to allow control system 110 to communicate with other components of warning infrastructure 100, including the one or more personal transport devices 120, vehicles 130, and/or warning lights 140. For example, in one embodiment, communication interface 114 can be a wireless transceiver that transmits and/or receives signals (e.g., commands, messages, information, etc.) to and/or from one or more of vehicles 120 and personal transport devices 130, as well as to their users and/or drivers, and to warning lights 140.

In some embodiments, control system 110 may also include accident database 116 that includes information associated with accidents or incidents involving vehicles and/or personal transport devices. For example, accident database 116 may include information about accidents or incidents within a predetermined distance from a location where warning infrastructure 100 is installed. Control system 110 may be configured to use the information stored in accident database 116 to determine areas where accidents or incidents including collisions between personal transport devices 120 and vehicles 130 are more likely to occur so that warnings or alerts may be prioritized in these areas.

Additionally, in some embodiments, accident database 116 may include other information that may be used by control system 110. For example, accident database 116 may also include information associated with one or more personal transport devices 120 and/or vehicles 130, such as identification or location information, which can be used by control system 110 to provide warnings about potential accidents or collisions.

In some embodiments, control system 110 can include other components not shown in FIG. 1 to facilitate providing warnings about parked vehicles and/or personal transport devices according to the example embodiments described herein.

As shown in FIG. 1, warning infrastructure 100 is configured to communicate with personal transport devices 120, including electric scooters and other types of small conveyances for moving people. In some embodiments, personal transport devices 120 can include a variety of information gathering mechanisms such as sensors that detect lighting condition, sensors that detect certain sounds such as emergency sounds, cameras or other optical devices that can detect markings on roadways or changes in roadways, and receivers that can receive information from roadway infrastructure or other vehicles. The information that may be received by personal transport devices 120 can include existing or future roadway infrastructure such as autonomous traffic infrastructure or adaptive traffic control systems which transmit or broadcast traffic information to vehicles and vehicle controllers. This information may include speed limits, traffic control signals, hazard warnings, etc. In this disclosure the term roadway infrastructure is intended to encompass these types of features and information.

In an exemplary embodiment, personal transport devices 120 may include a dock or other apparatus for receiving a mobile device, such as a smart phone or other type of portable computing device. With an application installed on mobile device, the mobile device may function as a display screen for personal transport devices 120 and provides a communication interface to an onboard controller or processor of the personal transport device, as well as allowing communication with communication interface 114 of control system 110. Communication between the mobile device and the onboard controller or processor, as well as with communication interface 114, may be accomplished by a variety of ways such as Bluetooth® or other types of short-range wireless or near-field communication protocols. The display screen of the mobile device may provide information to the user of the personal transport device regarding, for example, battery life, status of lighting units, distance traveled, speed, navigation information, hazard information and roadway infrastructure signals and readings. For example, in one embodiment, warnings provided by control system 110 of warning infrastructure 100 may also be provided to mobile devices associated with personal transport devices 120.

The application on the mobile device of personal transport devices 120 may also monitor and/or control some of the operating systems of the personal transport device. For example, information associated with braking, speed, location, heading, turn status, etc. can be monitored and/or controlled via the application on the mobile device. This information may also be provided to control system 110 of warning infrastructure 100 for providing warnings to drivers of vehicles 130 and/or to other users of personal transport devices 120.

As shown in FIG. 1, warning infrastructure 100 is also configured to communicate with vehicles 130, including motor vehicles such as cars and trucks and other types of vehicles that are configured to travel along roads where warning infrastructure 100 is located. In some embodiments, vehicles 130 can include a variety of information gathering mechanisms such as sensors, cameras, or other on-board systems that can measure information associated with the vehicle, including, but not limited to speed, location, braking, heading, turn status, operating status, parking information, door actuation, occupancy status, etc. This information may also be provided to control system 110 of warning infrastructure 100 for providing warnings to users of personal transport devices 120 and/or to other drivers of vehicles 130.

In some embodiments, vehicles 130 may include an on-board communication unit that uses Bluetooth® or other types of short-range wireless or near-field communication protocols to permit the vehicle to communicate with communication interface 114 of control system 110. Additionally, vehicles 130 may include an on-board display unit or other type of display screen inside the vehicle so that warnings provided by control system 110 of warning infrastructure 100 may also be provided to display screens associated with vehicles 130.

In an example embodiment, warning infrastructure 100 includes one or more warning lights 140 that may be deployed or installed at various locations within an area where warning infrastructure 100 is located. For example, warning lights 140 may be LED or other low-power lighting units that are located on or near a roadway, including on or in sidewalks, shoulders, bike lanes or paths, and pedestrian walkways or trails adjacent to or near vehicular traffic. In some embodiments, warning lights 140 may be embedded into the roadway or ground so that they are substantially flush with a surface of the roadway or the ground. In other embodiments, warning lights 140 may be mounted on poles or other mounting mechanisms, including on existing signs, parking meters, etc., so as to be spaced apart from the surface of the roadway or ground.

Figure 2:
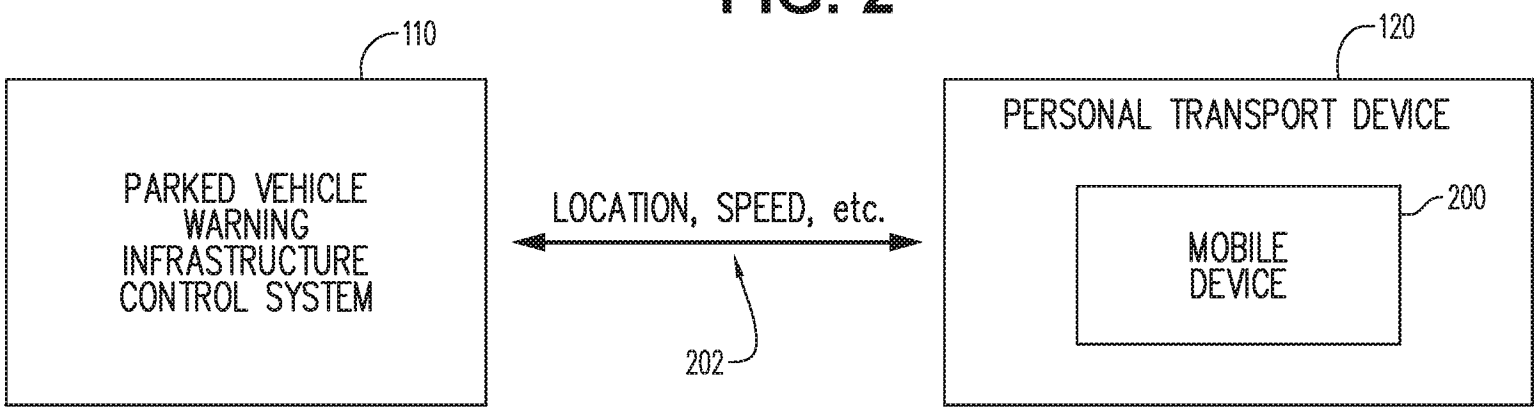
FIG. 2 is a schematic view of an example embodiment of a personal transport device in communication with the parked vehicle warning infrastructure.

In some embodiments, warning infrastructure 100 may be configured to communicate with personal transport devices 120, vehicles 130, or both to receive information about a vehicle and/or personal transport device that may be used to determine whether an alert or warning should be provided using warning lights 140. Referring now to FIG. 2, a schematic view of an example embodiment of personal transport device 120 in communication with control system 110 of parked vehicle warning infrastructure 100 is shown. In this embodiment, personal transport device 120 includes a mobile device 200, for example, a smart phone or other type of portable computing device, as described above.

When personal transport device 120 is traveling along a bike lane or other path on or near a roadway where warning infrastructure 100 is provided, mobile device 200 may be used to transmit or send information from personal transport device 120 to control system 110 of warning infrastructure 100. As shown in FIG. 2, mobile device 200 may provide information 202 about personal transport device 120, such as location, speed, heading, etc., so that control system 110 of warning infrastructure 100 may determine whether there is any risk of an accident or collision with any vehicles along the path of personal transport device 120.

For example, when a vehicle (e.g., one of vehicles 130) parks in a parking space near a bike lane or other path that is used by users of personal transport device 120, there is a risk that the driver or passenger may open a door of the vehicle into the path of the oncoming personal transport device 120. This type of accident is referred to as "dooring" and can cause serious injury to not only the user of a personal transport device, but also to the person opening the door. It can also cause significant damage to the personal transport device and/or vehicle. In addition, there is also a risk of collision between vehicles 130 and personal transport devices 120 that can occur as drivers of vehicles 130 are in the process of entering or exiting a parking space near the bike lane or other path used by personal transport devices 120.

Therefore, in these circumstances, control system 110 of warning infrastructure 100 may be configured to use one or more warning lights 140 to warn the users of personal transport devices 120 and/or drivers of vehicles 130 about the risk of an accident or collision. With this arrangement, the users of personal transport devices 120 and/or drivers of vehicles 130 are alerted to the potential risk and may exercise increased vigilance or awareness of their surroundings to avoid an accident or incident.

Figure 3:
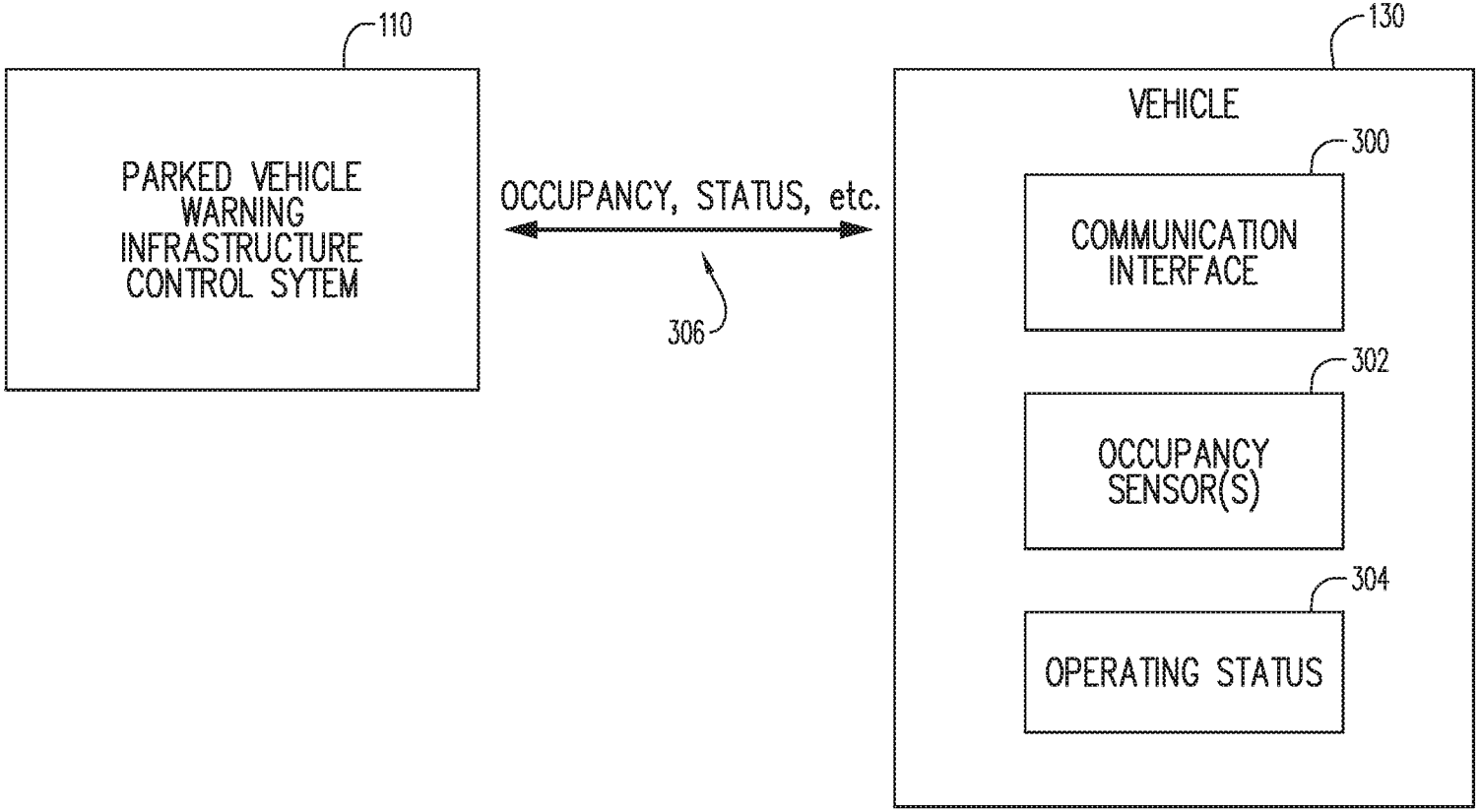
FIG. 3 is a schematic view of an example embodiment of a vehicle in communication with the parked vehicle warning infrastructure.

Referring now to FIG. 3, a schematic view of an example embodiment of vehicle 130 in communication with control system 110 of parked vehicle warning infrastructure 100 is shown. In this embodiment, vehicle 130 includes a communication interface 300 that allows vehicle 130 to communicate with communication interface 114 of control system 110, as well as with a driver of vehicle 130 or with other vehicles. For example, in some embodiments, communication interface 300 may use wireless network communication technologies, including short-range wireless or near-field communication technologies, to communicate.

In this embodiment, vehicle 130 may include one or more occupancy sensors 302. Occupancy sensors 302 may be any type of sensor that is configured to detect or sense the presence or absence of people inside vehicle 130. For example, occupancy sensors 302 use cameras (e.g., to obtain images of the interior of the vehicle to detect people), motion detectors (e.g., to sense movement within the interior of the vehicle), sound (e.g., to detect noises made by occupants within the vehicle), weight (e.g., to sense the presence of people sitting on seats inside the vehicle), or other sensors to detect whether or not a vehicle is occupied.

In some embodiments, vehicle 130 may also include one or more sensors or detectors associated with an operating status 304 of vehicle 130. For example, operating status 304 may include whether an engine or motor of the vehicle is currently running or engaged (i.e., whether the vehicle is on or off), an engaged gear or condition of a transmission of the vehicle (i.e., if the vehicle is in park, drive, reverse, etc.), whether or not a turn signal of the vehicle is actuated, whether one or more doors of the vehicle are locked, unlocked, or being actuated to open, as well as other information associated with a status or condition of the vehicle.

It should be understood, that in some embodiments, vehicle 130 may further include a variety of different types of sensors that are conventionally provided in vehicles, including, but not limited to a global position system (GPS) sensor, speed sensors, accelerometers, etc., that are configured to obtain data associated with the location and/or movement of vehicle 130, such as, for example, location, speed, heading, and other information associated with movement of vehicle 130.

As shown in FIG. 3, communication interface 300 of vehicle 130 may provide information 306 about vehicle 130, such as occupancy information (e.g., from occupancy sensors 302), status information (e.g., from operating status 304), as well as other relevant information, such as location, speed, heading, etc., so that control system 110 of warning infrastructure 100 may determine whether there is any risk of an accident or collision with any personal transport devices 120 when vehicle 130 is entering or exiting a parking space or when a driver or occupant of vehicle 130 is exiting vehicle 130 by opening a door (i.e., a potential "dooring" situation, as described above). Additionally, in some embodiments, control system 110 of warning infrastructure 100 may use a time-based criteria to determine whether there is a risk or an accident or collision. For example, control system 110 may be configured to provide a warning or alert by illuminating one or more of warning lights 140 for a predetermined time after a vehicle parks or an occupant enters into the vehicle.

In these circumstances, control system 110 of warning infrastructure 100 may be configured to use one or more warning lights 140 to warn the driver of vehicle 130 and/or the users of personal transport devices 120 about the risk of an accident or collision. With this arrangement, drivers of vehicles 130 and/or the users of personal transport devices 120 are alerted to the potential risk and may exercise increased vigilance or awareness of their surroundings to avoid an accident or incident.

Figure 4:
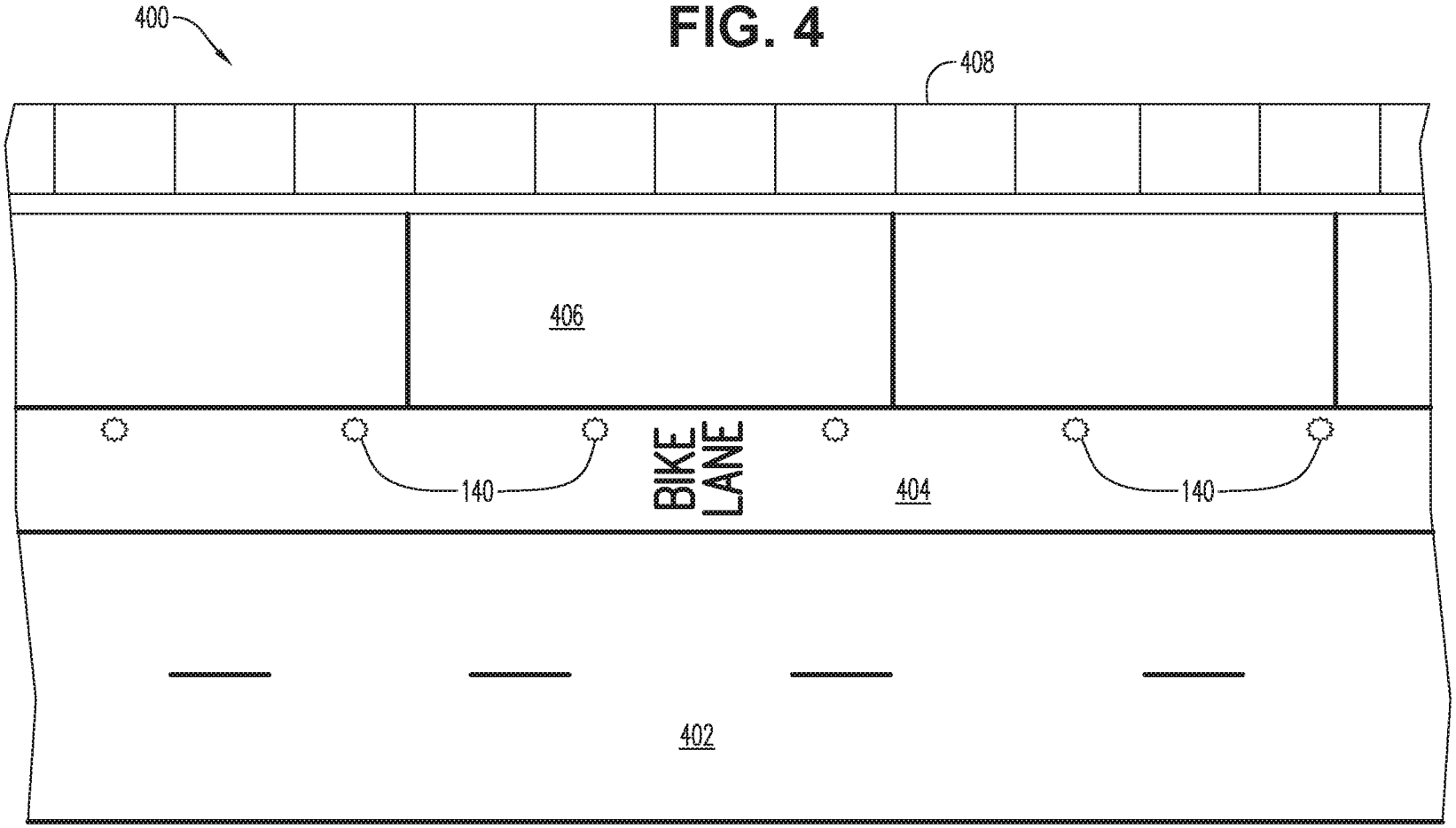
FIG. 4 is a representative view of an example embodiment of a configuration of a parked vehicle warning infrastructure.
Figure 5:
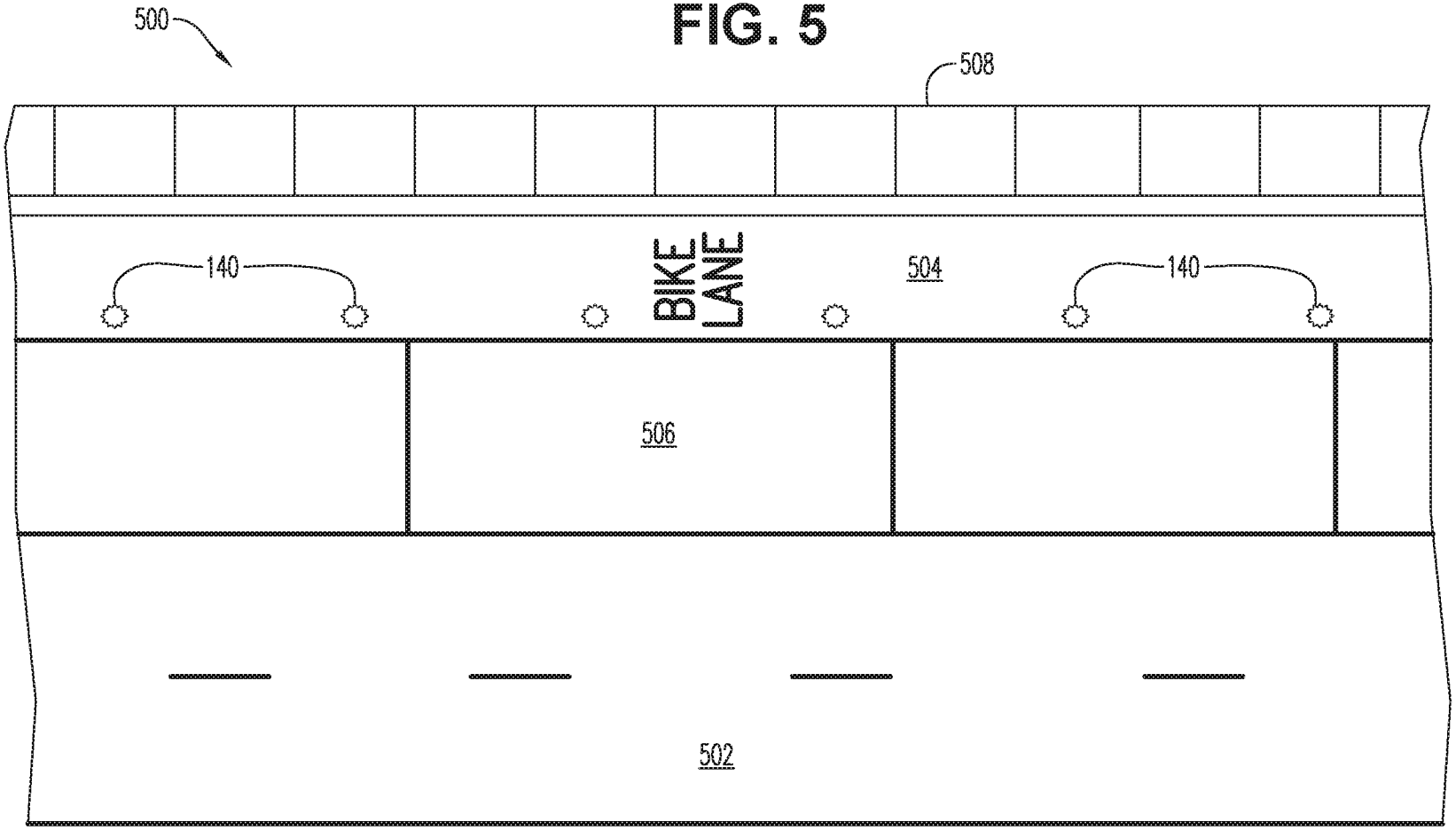
FIG. 5 is a representative view of another embodiment of a configuration of a parked vehicle warning infrastructure.
Figure 6:
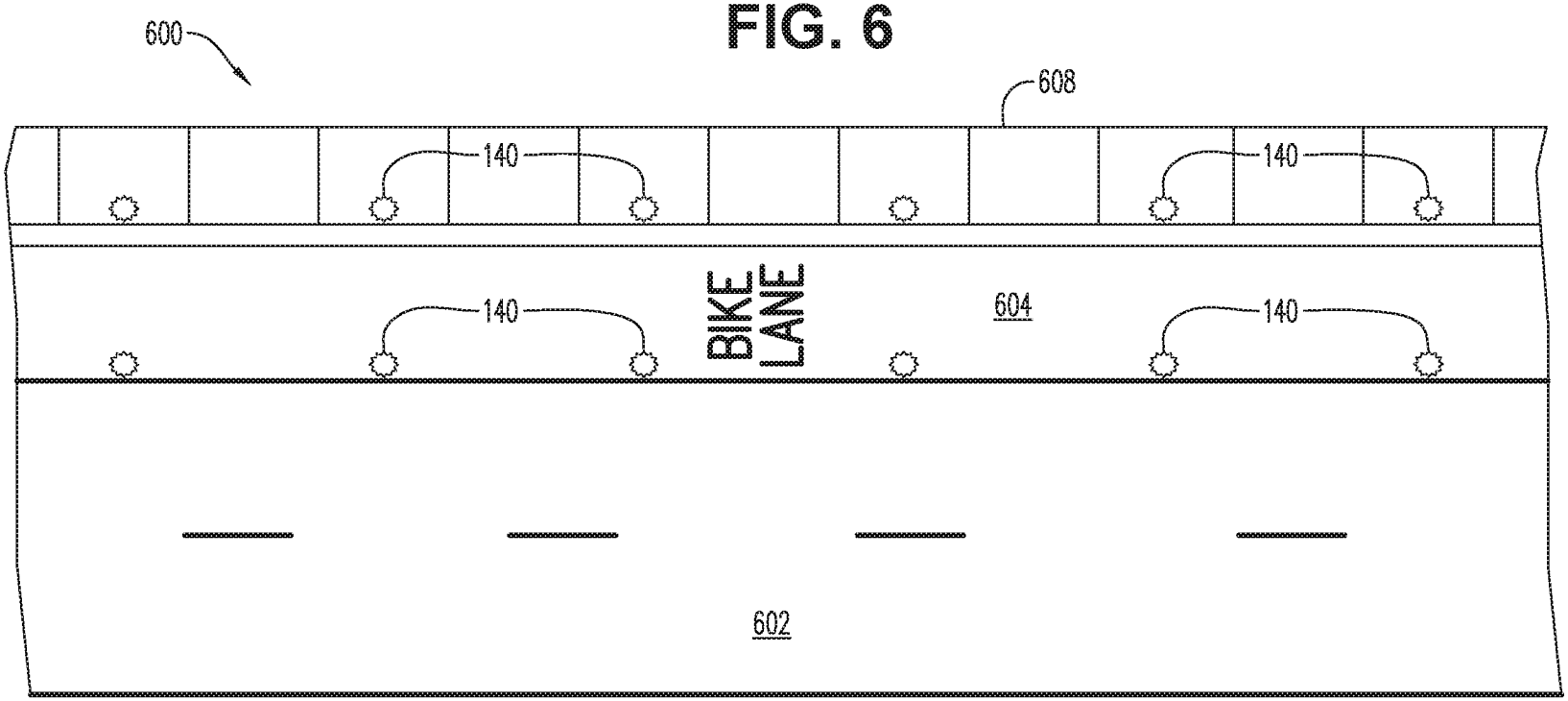
FIG. 6 is a representative view of another embodiment of a configuration of a parked vehicle warning infrastructure.

In some embodiments, parked vehicle warning infrastructure 100 may be provided at various locations, for example, at locations where there is a high density of small personal transport device and vehicular traffic, such as cities and other urban type environments. As shown in FIGS. 4 through 6, example environments in which warning infrastructure 100 may be provided are illustrated. However, it should be understood that warning infrastructure 100 according to the techniques described herein may be provided at any desired location.

Referring now to FIG. 4, an environment 400 for warning infrastructure 100 is shown according to an example embodiment. In this embodiment, environment 400 includes a roadway 402, a dedicated bike lane 404, and a parking zone 406, with bike lane 404 being located between roadway 402 and parking zone 406. For example, environment 400 illustrates a common configuration in cities or other areas that have dedicated bike lanes 404 on one side of roadway 402 adjacent to or near parking spaces in parking zone 406. Additionally, in this embodiment, a sidewalk 408 is located on one side of parking zone 406 on the opposite side of bike lane 404. With this arrangement, vehicular traffic is expected to drive on roadway 402 and personal transport devices, such as electric scooters, are expected to use bike lane 404.

As can be seen in FIG. 4, because parking zone 406 is located on the opposite side of bike lane 404 from roadway 402, vehicles that are entering or exiting parking zone 406 may pose a risk of a collision to users of bike lane 404. Additionally, when a vehicle is occupying parking zone 406, a driver or passenger may open a door of the vehicle into the space provided for bike lane 404, thereby potentially causing an accident or collision with users of personal transport devices traveling on bike lane 404. In this embodiment, environment 400 includes warning lights 140 provided in the surface of bike lane 404 adjacent to or near parking zone 406. With this arrangement, warning lights 140 may provide an alert or notification to users of personal transport devices traveling on bike lane 404 to watch out for vehicles entering, exiting, or occupying parking zone 406 that pose a risk of collision or accident.

Referring now to FIG. 5, an environment 500 for warning infrastructure 100 is shown according to another example embodiment. In this embodiment, environment 500 includes a roadway 502, a dedicated bike lane 504, a parking zone 506, and a sidewalk 508. As shown in FIG. 5, bike lane 504 is located between sidewalk 508 and parking zone 506. Environment 500 illustrates a configuration with dedicated bike lanes 504 adjacent to or near parking spaces in parking zone 506 and spaced apart from roadway 502. With this arrangement, vehicular traffic is expected to drive on roadway 502 and personal transport devices, such as electric scooters, are expected to use bike lane 504.

As can be seen in FIG. 5, because parking zone 506 is located on one side of bike lane 504, when a vehicle is occupying parking zone 506, an occupant of a vehicle parked in parking zone 506 may open a door on the passenger side of the vehicle into the space provided for bike lane 504, thereby potentially causing an accident or collision with users of personal transport devices traveling on bike lane 504. In this embodiment, environment 500 includes warning lights 140 provided in the surface of bike lane 504 adjacent to or near parking zone 506. With this arrangement, warning lights 140 may provide an alert or notification to users of personal transport devices traveling on bike lane 504 to watch out for vehicles entering, exiting, or occupying parking zone 506 that pose a risk of collision or accident.

Referring now to FIG. 6, an environment 600 for warning infrastructure 100 is shown according to another example embodiment. In this embodiment, environment 600 includes a roadway 602, a bike lane 604, and a sidewalk 608. As shown in FIG. 6, bike lane 604 is located between sidewalk 608 and roadway 602. Environment 600 illustrates a configuration with bike lanes 604 adjacent to or near roadway 602, without a designated parking zone being present. As a result, in areas with similar configurations as environment 600, vehicles may park along roadway 602 or in the area marked for bike lane 604. With this arrangement, vehicular traffic is expected to drive on roadway 602 and personal transport devices, such as electric scooters, are expected to use bike lane 604.

As can be seen in FIG. 6, because no parking zone for vehicles is provided, vehicles may park in roadway 602 on one side of bike lane 604 or may park in bike lane 604. When an occupant of a vehicle parked along roadway 602 opens a door on the passenger side of the vehicle into the space provided for bike lane 604, an accident or collision with users of personal transport devices traveling on bike lane 604 may occur. Additionally, when a vehicle is parked in bike lane 604, a user of a personal transport device may need to move into roadway 602 or onto sidewalk 608 to avoid the parked vehicle. That is, environment 600 includes potential accident or collision risks on both sides of bike lane 604.

In this embodiment, therefore, environment 600 includes warning lights 140 provided not only in the surface of bike lane 604 adjacent to or near roadway 602, but also in the surface of sidewalk 608. With this arrangement, warning lights 140 may provide an alert or notification to users of personal transport devices traveling on bike lane 604 to watch out for vehicles entering, exiting, or occupying roadway 602 and/or bike lane 604 that pose a risk of collision or accident.

The example environments described above in reference to FIGS. 4-6 are merely exemplary and other configurations or arrangements of warning infrastructure 100 may be provided. It should also be noted that different jurisdictions may have laws and/or regulations regarding the use of personal transport devices, including prohibitions or restrictions on using roadways, bike lanes, and/or sidewalks. Accordingly, embodiments of warning infrastructure 100 may be provided based, at least in part, on the particular laws and/or regulations of a jurisdiction in which warning infrastructure 100 is located.

Figure 7:
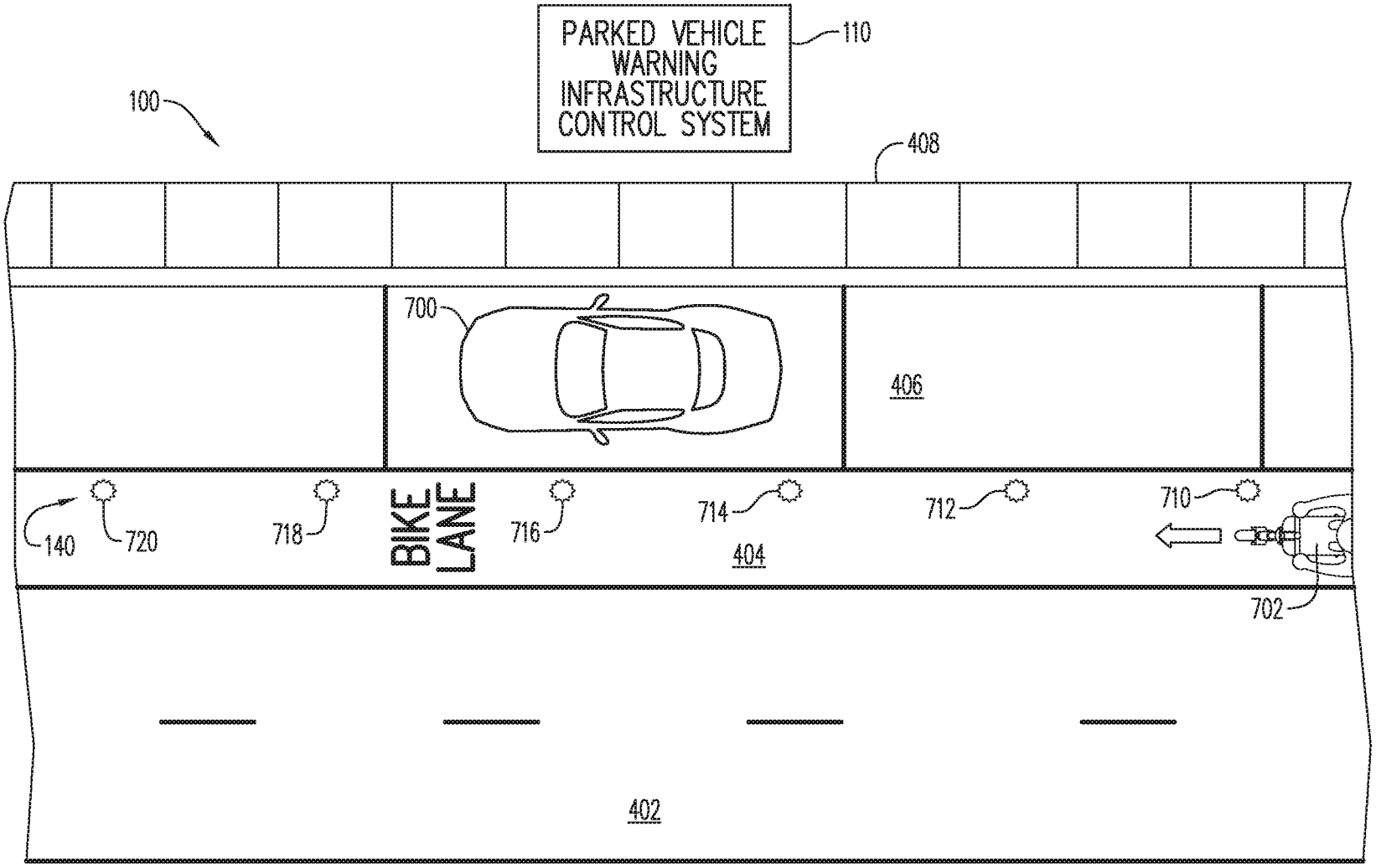
FIG. 7 is a representative view of a parked vehicle warning infrastructure according to an example scenario.
Figure 8:
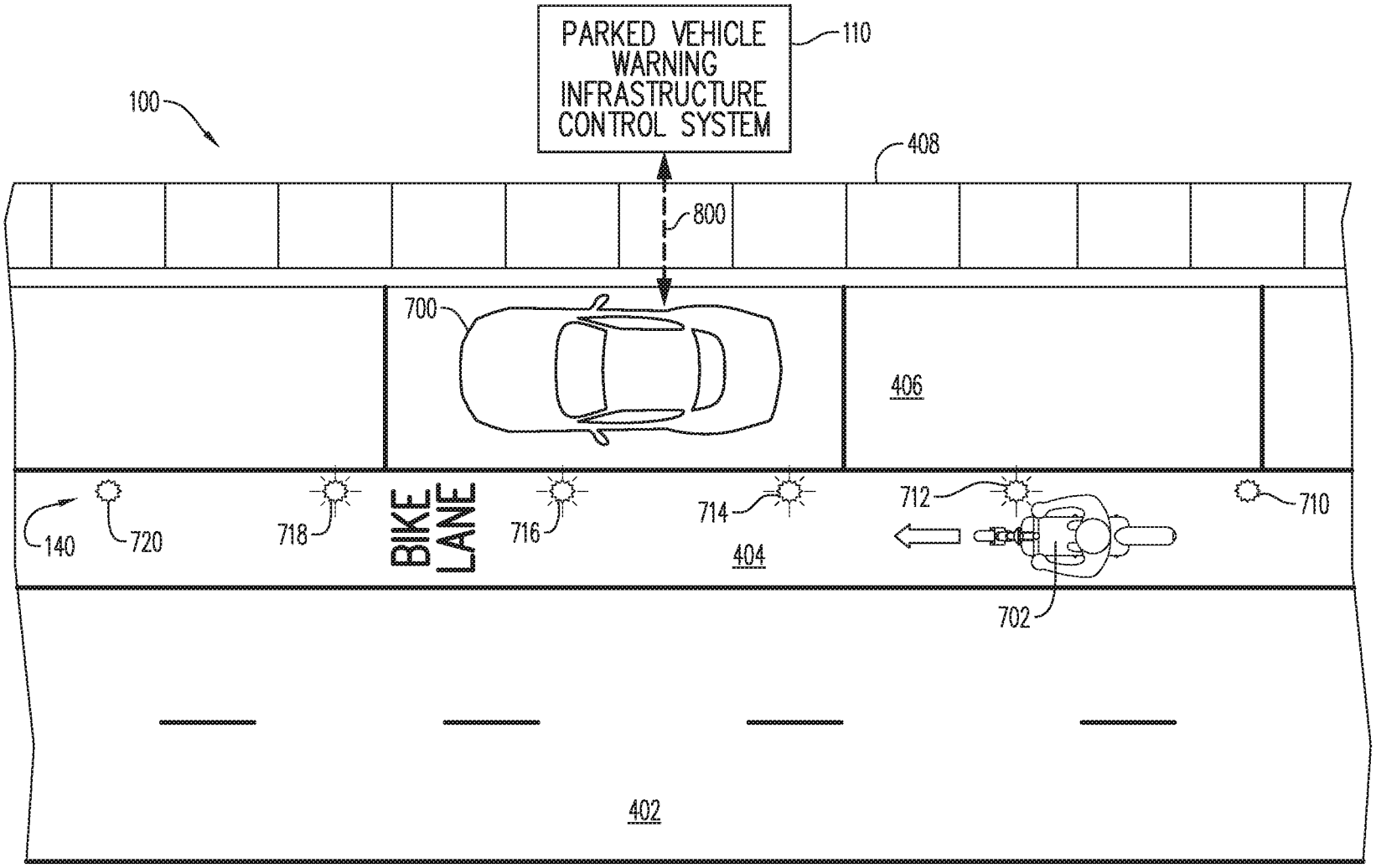
FIG. 8 is a representative view of the parked vehicle warning infrastructure in communication with a vehicle according to an example scenario.
Figure 9:
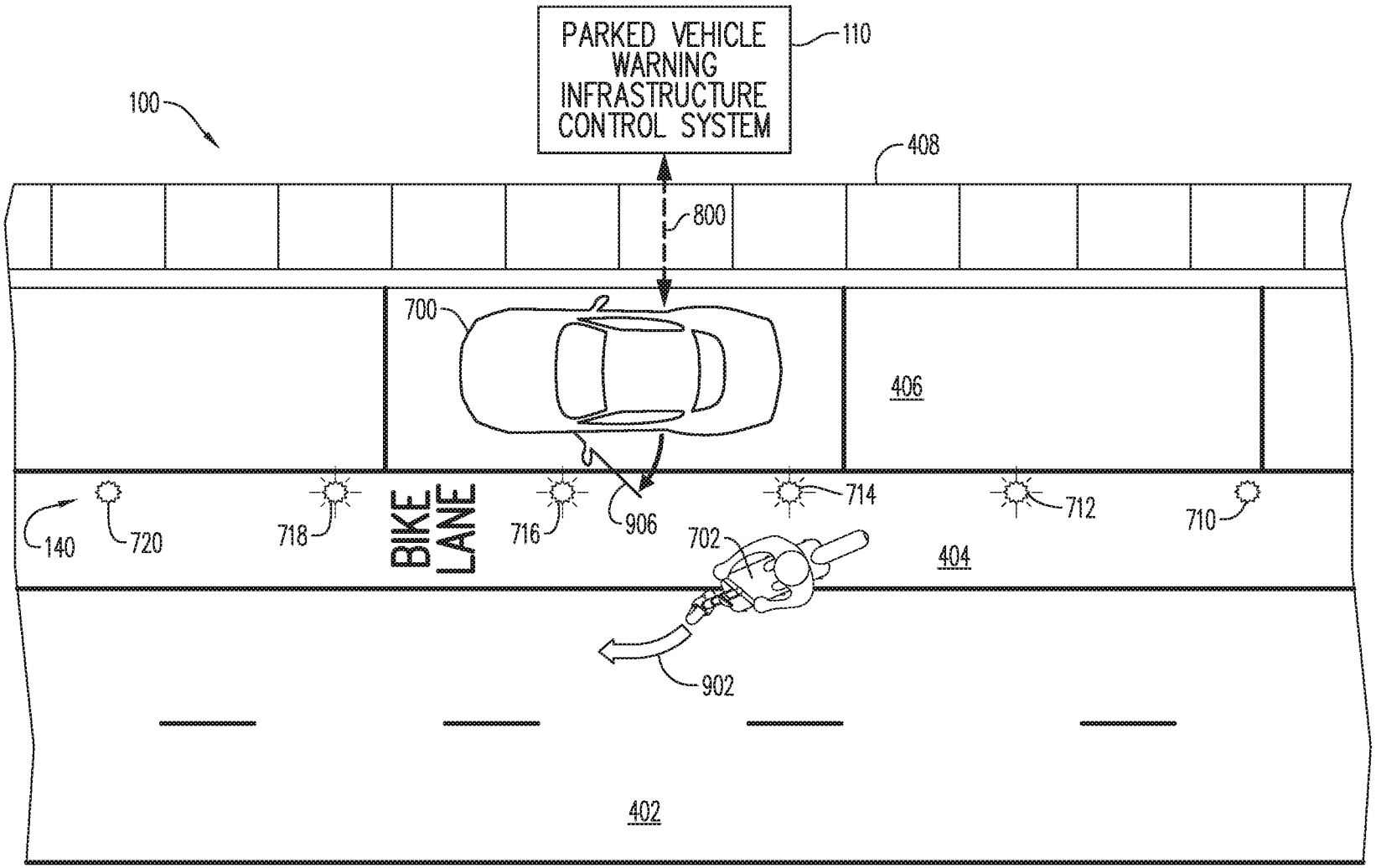
FIG. 9 is a representative view of the parked vehicle warning infrastructure providing a warning to a rider of an electric scooter according to an example scenario.

Referring now to FIGS. 7 through 9, an example scenario illustrating warning infrastructure 100 in use to provide a warning to a user of a personal transport device and/or to a driver of a vehicle is shown. As shown in FIG. 7, the example scenario is described with reference to environment 400 for warning infrastructure 100, as described above, including roadway 402, bike lane 404, parking zone 406, and sidewalk 408. In this embodiment, control system 110 of warning infrastructure 100 is located near environment 400, for example, on or adjacent to sidewalk 408. In other embodiments, control system 110 may be located elsewhere within environment 400.

In this embodiment, a parked vehicle 700 is parked in a parking space within parking zone 406 in between sidewalk 408 and bike lane 404. In this example scenario, a user of a personal transport device, such as a scooter 702, is traveling along bike lane 404 and approaching parked vehicle 700. As described above, environment 400 includes warning lights 140 disposed in a surface of bike lane 404 along the side adjacent to parking zone 406. In this embodiment, warning lights 140 include a first light 710, a second light 712, a third light 714, a fourth light 716, a fifth light 718, and a sixth light 720. In other embodiments, a smaller or larger number of warning lights 140 may be provided.

Referring now to FIG. 8, parked vehicle 700 communicates with control system 110 of warning infrastructure 100 to provide information 800 about parked vehicle 700, as described above with reference to FIG. 3. For example, in this embodiment, information 800 transmitted from parked vehicle 700 to control system 110 may include status information indicating that parked vehicle 700 has placed its transmission into park and turned off its engine. Accordingly, based on information 800, control system 110 may determine that there is a potential risk of an accident or collision with approaching scooter 702 traveling in bike lane 404. In response, control system 110 provides an instruction or command to one or more of warning lights 140 to illuminate to provide a visual alert or warning to the user of scooter, as well as to the driver or passengers of parked vehicle 700.

For example, as shown in FIG. 7, the warning lights 140 ahead of scooter 702 in bike lane 404 are illuminated, including second light 712, third light 714, fourth light 716, and fifth light 718. In some embodiments, warning lights 140 may illuminate using various colors, or may be configured to flash or strobe to provide an alert or warning to user of scooter 702 and/or to one or more occupants of parked vehicle 700. Additionally, in some embodiments, an intensity or brightness of warning lights 140 may be modified or varied based on environmental conditions around warning infrastructure 100. For example, when there is a large amount of ambient light, such as during the day or when it is sunny, warning lights 140 may be illuminated with a greater brightness or intensity so that the light from warning lights 140 is visible against the ambient light. Similarly, when there is less ambient light, such as at night or when it is raining or cloudy, warning lights 140 may be illuminated with a lesser brightness or intensity.

With this arrangement, the user of scooter 702 and the driver or passenger of parked vehicle 700 may be alerted or warned that there is a potential for an accident or collision between parked vehicle 700 and the approaching scooter 702. In other words, illumination of warning lights 140 (e.g., second light 712, third light 714, fourth light 716, fifth light 718, in this embodiment) allows users of personal transport devices and drivers or passengers of vehicles to exercise heighted vigilance in the presence of each other when control system 110 of warning infrastructure 100 determines a risk of accident or collision.

For example, as shown in FIG. 9, when the driver of parked vehicle 700 opens a door 900 of parked vehicle 700 into bike lane 404 while the user on scooter 702 is approaching, the illumination of warning lights 140 (e.g., second light 712, third light 714, fourth light 716, fifth light 718) by control system 110 of warning infrastructure 100 allows user on scooter 702 to have advance warning of the potential for an accident or collision. In response, user on scooter 702 has sufficient warning time to be able to take an evasive action 902 to avoid door 900 in bike lane 404. For example, as shown in this embodiment, evasive action 902 taken by user on scooter 702 is to swerve out of the reach of door 900 in bike lane 404 and into roadway 402. Thus, the techniques of the example embodiments can assist users of personal transport devices and drivers of vehicles to avoid potential accidents and collisions with each other.

Figure 10:
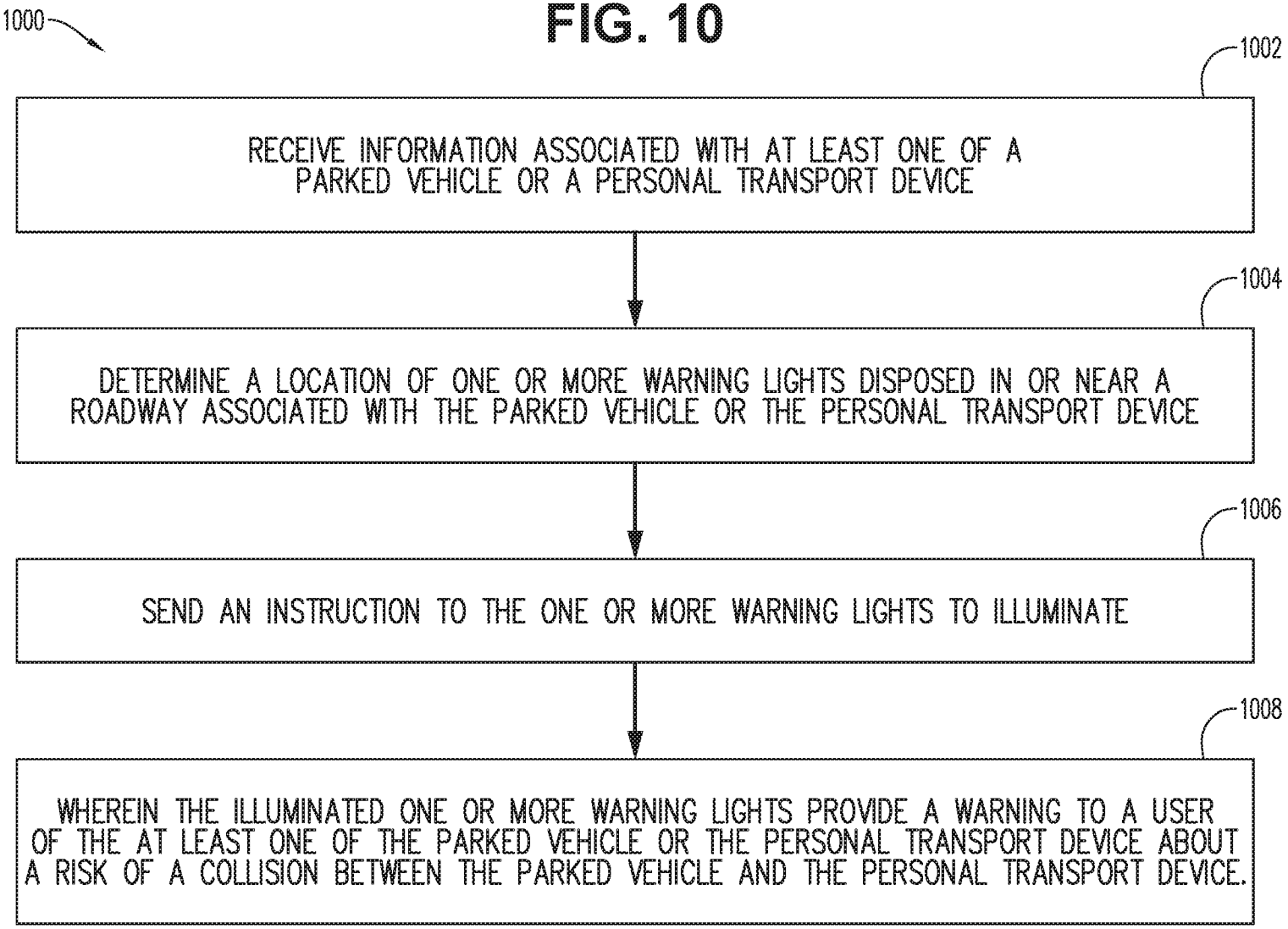
FIG. 10 is a flowchart of a method for providing a warning about parked vehicles according to an example embodiment.

FIG. 10 illustrates a flowchart of an example embodiment of a method 1000 for providing a warning about parked vehicles. In one embodiment, method 1000 may be implemented by control system 110 of warning infrastructure 100. In this embodiment, method 1000 begins at an operation 1002, where information associated with at least one of a parked vehicle or a personal transport device is received. For example, as shown above in reference to FIGS. 7-9, at operation 1002, control system 110 may receive information 800 from parked vehicle 700 and/or may also receive information from scooter 702.

Next, method 1000 includes an operation 1004. At operation 1004, a location of one or more warning lights disposed in or near a roadway associated with the parked vehicle or the personal transport device is determined. For example, as shown above in reference to FIGS. 7-9, at operation 1004, control system 110 may determine the location of one or more of warning lights 140 disposed along bike lane 404 near roadway 402, including second light 712, third light 714, fourth light 716, fifth light 718.

In some embodiments, determining the location at operation 1004 may take into account information about an approaching personal transport device, such as speed, heading, location, etc., to determine the identity and location of which warning lights are sufficiently in front of the approaching personal transport device so that they may be visible to a user before reaching the parked vehicle. For example, as shown in FIG. 8, second light 712, third light 714, fourth light 716, and fifth light 718 are illuminated in front of scooter 702 as it approaches parked vehicle 700. In contrast, first light 710 is not illuminated because it will already be located behind scooter 702 and cannot provide a warning to the user.

Method 1000 also includes an operation 1006, where an instruction to illuminate is sent to the one or more warning lights whose location were determined at operation 1004. For example, as described above, second light 712, third light 714, fourth light 716, and fifth light 718 are illuminated along bike lane 404. Upon illumination of the warning lights at operation 1006, method 1000 proceeds to an operation 1008, where the illuminated warning lights provide a warning to a user of the at least one of the parked vehicle or the personal transport device about a risk of collision between the parked vehicle and the personal transport device. For example, at operation 1008, a user of scooter 702 and/or a user of parked vehicle 700 (i.e., the driver or a passenger)

may be warned of the risk of accident or collision between parked vehicle 700 and scooter 702 by the illumination of second light 712, third light 714, fourth light 716, and fifth light 718. Thus, the user of scooter 702 may take evasive action 902 to avoid colliding with door 900 of parked vehicle 700 which has been opened into bike lane 404, as shown in FIG. 9 above.

Additionally, in some embodiments, control system 110 of warning infrastructure 100 may use information stored in accident database 116, described above in reference to FIG. 1, as part of method 1000. For example, the information stored in accident database 116 may assist control system 110 with determining the risk of collision and/or the location of warning lights to illuminate based on historical accident information contained in accident database 116. In other embodiments, one or more warning lights may be illuminated based on information in accident database 116 that indicates a location has a high incidence of previous accidents or collisions. In these embodiments, one or more warning lights may be illuminated to warn the user of a personal transport device or a driver or passenger of a vehicle to exercise increased vigilance or awareness at that location.

In some embodiments, the one or more warning lights described herein may also include components configured to provide an aural or auditory warning in addition to the illumination of the warning lights. For example, a warning sound or alert noise may also be provided using a speaker or other mechanism to further provide a warning to user of personal transport devices or vehicles to be aware of the potential for an accident or collision.

While the personal transport device relative to the exemplary embodiment here is illustrated and described as an electric scooter, any type of small, personal transport vehicle could be employed, such as an electric skateboard, one- and two-wheeled self-balancing boards, electric bicycles or e-bikes, electric-assisted mopeds, small electric-powered mobility transporters, etc.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

The invention claimed is:

1. A method for providing a warning about parked vehicles using a parked vehicle warning infrastructure, the method comprising:

receiving, at a control system of the parked vehicle warning infrastructure, at least one of: (1) an operating status or an occupancy status from an on-board communication unit of a parked vehicle, or (2) a speed, location, or heading from a mobile device associated with a personal transport device;

determining, by the control system, a location of one or more warning lights disposed in or adjacent to a roadway associated with the parked vehicle or the personal transport device;

based on the received at least one of the operating status or occupancy status of the parked vehicle and/or the speed, location, or heading from the mobile device, determining a risk of a collision between the parked vehicle and the personal transport device;

upon determining the risk of a collision, the control system sending an instruction to the one or more warning lights to illuminate; and wherein the illuminated one or more warning lights provide a warning to a user of the at least one of the parked vehicle or the personal transport device about the risk of a collision between the parked vehicle and the personal transport device.

2. The method according to claim 1, wherein the occupancy status is received by the control system from an occupancy sensor located in the parked vehicle.

3. The method according to claim 1, wherein the operating status from the parked vehicle is received by the control unit from the on-board communication unit of the parked vehicle using short-range wireless communication.

4. The method according to claim 1, wherein the at least one operating status of the parked vehicle includes one or more of whether an engine or motor of the parked vehicle is currently running, an engaged gear or condition of a transmission of the parked vehicle, whether or not a turn signal of the parked vehicle is actuated, or whether one or more doors of the parked vehicle are locked, unlocked, or being actuated to open.

5. The method according to claim 1, wherein the speed, location, or heading from the mobile device associated with the personal transport device is determined by a GPS sensor within the mobile device.

6. The method according to claim 1, wherein determining the location of the one or more warning lights by the control system of the parked vehicle warning infrastructure includes using the received speed, location, or heading from the mobile device associated with the personal transport device to determine which of the one or more warning lights are located in front of a travel direction of the personal transport device.

7. The method according to claim 1, wherein determining the location of the one or more warning lights by the control system of the parked vehicle warning infrastructure includes accessing historical accident information stored in an accident database.

8. The method according to claim 1, wherein the one or more warning lights are disposed in a surface of at least one of the roadway, a bike lane, a parking zone, or a sidewalk.

9. The method according to claim 1, wherein a dedicated bike lane is located adjacent to the roadway; and wherein the one or more warning lights are disposed in the dedicated bike lane.

10. A method of providing a warning of a potential accident or collision from a parked vehicle warning infrastructure, the method comprising:

receiving, at a control system of the parked vehicle warning infrastructure, from at least one of: (1) an operating status or an occupancy status from an on-board communication unit of a parked vehicle, or (2) a speed, location, or heading from a mobile device associated with a personal transport device;

based on the received at least one of the operating status or occupancy status of the parked vehicle and/or the speed, location, or heading from the mobile device, determining a risk of a collision between the parked vehicle and the personal transport device;

using a location of the parked vehicle or the speed, location, or heading of the personal transport device to determine a location of a selected one or more warning lights disposed in or adjacent to a roadway associated with the parked vehicle or the personal transport device; and illuminating the selected one or more warning lights in or adjacent to the roadway to provide a warning to a user of the at least one of the parked vehicle or the personal transport device about the determined risk of a collision between the parked vehicle and the personal transport device.

11. The method according to claim 10, wherein illuminating the selected one or more warning lights includes strobing the warning lights.

12. The method according to claim 10, wherein illuminating the selected one or more warning lights includes using a color to illuminate the warning lights.

13. The method according to claim 10, further including providing an aural warning when illuminating the selected one or more warning lights.

14. The method according to claim 10, wherein the one or more warning lights are disposed in a surface of at least one of the roadway, a bike lane, a parking zone, or a sidewalk.

15. The method according to claim 10, wherein the one or more warning lights are mounted on an existing sign on at least one of the roadway, a bike lane, a parking zone, or a sidewalk.

16. A system for a parked vehicle warning infrastructure, comprising:

one or more warning lights located in or adjacent to a roadway;

a control system for the parked vehicle warning infrastructure, the control system including:

a communication interface using short-range wireless communication to communicate with the one or more warning lights and at least one of a mobile device associated with a personal transport device or an on-board communication unit of a vehicle traveling on or adjacent to the roadway; and a processor configured to:

receive at least one of: (1) a speed, location, or heading from the mobile device associated with the personal transport device, or (2) an operating status or an occupancy status from the on-board communication unit of the vehicle, based on the received at least one of the speed, location, or heading from the mobile device and/or the operating status or occupancy status of the vehicle, determine a risk of a collision between the vehicle and the personal transport device;

upon determining the risk of a collision, determine a location of a selected one or more of the warning lights in or adjacent to the roadway, and send an instruction to the selected one or more of the warning lights to illuminate to warn a user of the personal transport device or the vehicle of the risk of a collision.

17. The system according to claim 16, wherein the one or more warning lights are disposed in a surface of at least one of the roadway, a bike lane, a parking zone, or a sidewalk.

18. The system according to claim 16, wherein a dedicated bike lane is located adjacent to the roadway; and wherein the one or more warning lights are disposed in the dedicated bike lane.

19. The system according to claim 16, wherein the control system further includes an accident database; and wherein the processor of the control system is configured to use historical accident information stored in the accident database to determine the location of the selected one or more of the warning lights.

20. The system according to claim 16, wherein the occupancy status is received by the processor from an occupancy sensor located in the vehicle.

* * * * *